US006115857A

United States Patent [19]

Bidegain

[11] Patent Number: 6,115,857

[45] Date of Patent: Sep. 12, 2000

[54] FOOT SUPPORT

[76] Inventor: Marty E. Bidegain, P.O. Box 11171, Casa Grande, Ariz. 85230

[21] Appl. No.: 09/351,158

[22] Filed: Jul. 12, 1999

[51] Int. Cl.[7] ..... A47K 3/024

[52] U.S. Cl. ..... 4/574.1; 4/611; 4/579; 4/571.1; D6/524; D6/525; D6/553

[58] Field of Search ..... 4/559, 574.1, 579, 4/571.1, 573.1, 577.1, 611; 297/423.39, 423.41; D6/524, 525, 553

[56] References Cited

U.S. PATENT DOCUMENTS

| | | | |
|---|---|---|---|
| D. 191,573 | 10/1961 | Pierchalski | D6/525 |
| D. 287,075 | 12/1986 | Collin et al. | D6/524 |
| D. 289,840 | 5/1987 | Burkes | D6/525 |
| D. 400,382 | 11/1998 | Wendt | D6/553 |
| 1,232,223 | 7/1917 | Clarke | 4/574.1 |
| 4,385,408 | 5/1983 | Rhodes | 4/579 |
| 4,630,861 | 12/1986 | Henschel | D6/353 |
| 5,340,070 | 8/1994 | Soma | 4/574.1 |
| 5,579,545 | 12/1996 | Beard | 4/574.1 |
| 5,640,723 | 6/1997 | Stanek | 4/571.1 |
| 5,647,072 | 7/1997 | Shaffer et al. | 4/574.1 |
| 5,920,926 | 7/1999 | Torres | 4/574.1 |

FOREIGN PATENT DOCUMENTS

| | | | |
|---|---|---|---|
| 2405599 | 8/1975 | Germany | 4/574.1 |
| 20956 | 9/1909 | United Kingdom | 4/579 |

*Primary Examiner*—Henry J. Recla
*Assistant Examiner*—Khoa D. Huynh
*Attorney, Agent, or Firm*—Gregory J. Nelson

[57] ABSTRACT

A portable foot support for supporting the foot and leg of a person to accommodate shaving and other personal grooming activities in a bathing enclosure or other location. The support has a base and a top with a convex foot pad extending from the top to the front side. One or more receptacles for grooming articles are provided. The base has a hanger which facilitates storage of the foot support on the edge of a bath tub. The hanger may be a recess in the side wall to accommodate placement over tub walls of different thicknesses or may be a slidable hanger engageable over the top of the tub wall. Preferably the support is one-piece, molded from plastic and is sanitary, durable, light weight and resistive to corrosion.

10 Claims, 4 Drawing Sheets

FOOT SUPPORT

FIELD OF THE INVENTION

The present invention relates to a grooming aid and more particularly to a support that may be employed in a bathtub, shower stall or other location to receive the foot and stabilize the leg of a person and to store grooming aids when the person is shaving his or her legs.

BACKGROUND OF THE INVENTION

It is common practice for a person to shave his or her legs. Women customarily shave their legs for cosmetic reasons and both men and women often shave their legs when engaged in sporting activities such as competitive swimming or bicycle racing.

When a person desires to shave his or her legs, shaving most often is accomplished when bathing, either in a bathtub or in a shower stall. In both situations, shaving the legs can be difficult and cuts to the skin or damage such as razor burns often occur as shaving the legs is an awkward procedure. In bathtubs, the person will generally attempt to rest his or her foot on the ledge or end of the tub while sitting in the tub and proceed with the shaving operation. In this wet and soapy environment it is easy for the person's leg to slip which can result in cuts. The procedure is further complicated by the unavailability of a convenient location for the person to place grooming aids when shaving. When shaving it is generally necessary for the person to have shaving soap, generally an aerosol and a razor. After the soap is applied to the leg surface to be shaved, the person will generally place the soap on the ledge of the tub and retrieve the razor which has been previously placed there for use. It is easy for both the container of soap and the razor to slip into the tub making the shaving operation even more difficult and awkward.

Similar difficulties are encountered when a person attempts to shave in a shower stall. When standing in the shower stall, a person will generally lean from the waist attempting to shave the lower leg portions. Another approach is for the person to stand on one foot and maintain balance while bracing the other foot against a wall of the shower stall. Either operation is somewhat hazardous as the person may slip or fall in the wet slippery environment of the shower. Also, accessibility to grooming aids is not convenient as generally these are either placed on the floor of the shower stall or maintained in a caddy suspended from the shower head.

Various foot support and grooming holders can be found in the prior art.

U.S. Pat. No. 5,579,545 describes a combined foot support and grooming holder which is designed to provide elevation and support for a human foot and grooming needs while washing, drying and pedicuring the foot or shaving the leg. The device can be used inside or outside of the shower or bath. The device is a two-part, single leg, elongate support member with a two-part platform.

U.S. Pat. No. 5,647,072 shows a foot support for shower areas which mounts in the corner of the walls formed by the shower area to support the foot and leg of the bather while washing or shaving. The device has a shelf panel and is supported above the shower basin and is oriented at an oblique angle to the base. The mounting structure mounts the shelf panel to the walls and includes a pair of mounting panels that confront the walls. The shelf panel and the mounting panel are formed as a crescent shaped integral piece of molded plastic and the mounting panels are hinged along linear sections that define lateral side edges for the shelf panel. Drain openings are formed through the shelf panel and reinforcing ribs extend around these openings. Reinforcing lips extend along the front and rear edges of the shelf panel and also provide limit stops to help position the mounting panels. The mounting panels are provided with adhesive strips to adhere the foot support to the shower walls. Alternatively the foot support may be formed as interlocking cantilevered panels.

U.S. Pat. No. 5,340,070 discloses a plate or fixture which is mounted in a shower stall or bathing area with a unitary body having a vertically extending portion and a forwardly extending portion. The forwardly extending portion is downwardly inclined. The upper surface provides an area for receiving the ball of the foot to facilitate shaving of the legs.

While devices of the type described above provide some assistance and convenience to the user, they have certain advantages. Generally the prior art devices require that they be permanently installed within the shower stall or tub area and are not attractive and present cleaning difficulties and for this reason are not sanitary. Further, permanent installation at a particular location may not be convenient or suitable for use by persons of various heights. Devices that are not permanently attached may be inconvenient to store when not in use. Further, while many of the prior art devices provide foot support they do not provide a convenient location for the storage of grooming needs which are used during shaving of the legs.

Accordingly, there exists a need for a grooming accessory which will provide support to assist a person in shaving or washing a leg or performing other operations such as pedicuring or applying lotions and creams.

SUMMARY OF THE INVENTION

It is a primary object of the present invention to provide a foot support device which may be used in a bath, a shower or vanity area and which will support the foot and the leg of the user in a comfortable, stable position when the user is performing grooming operations such as pedicuring, shaving and washing the leg.

It is another object of the present invention to provide a portable support which may be conveniently stored on the edge of a tub when not in use.

It is another object of the present invention to provide a foot support device which is unitary and may be used in a tub, shower or vanity area and does not require permanent attachment to these areas.

It is still another object of the invention to provide a foot support which also has provision for storage of various grooming aids such as razors, soaps, shaving creams, lotions and the like.

It is still another object of the present invention to provide a foot support for use in shower and bathing areas which is pleasing in appearance, safe and convenient to use.

Yet another object of the present invention is to provide a foot support which has a compliant curved foot rest surface which comfortably receive the foot and retains the foot against slipping.

Briefly, the foot support of the present invention has a housing with side walls and a top surface. The bottom is open. At the intersection of the front wall and the top surface, one or more foot rest surfaces are provided. The foot rest surfaces are curved and preferably have a non-slip resilient surface which comfortably receives and retains the ball or arch area of the foot of the user. The upper surface defines one or more recesses which can receive and store grooming accessories such as razors, shaving creams, soaps and the like. The bottom edges of the walls are provided with an anti-slip material which will resist slipping when the device is in a use-position.

In one embodiment, the opposite side walls of the support define a cut-out so that when not in use the support may be stored on the edge of a tub by engaging the tub wall in the cut outs. The cut-outs accommodate tubs having varying wall thicknesses and the cut-outs may be generally upwardly converging being stepped or in an inverted "V" or "U" shape. The device is preferably an integrally molded plastic structure so as to be light weight, corrosion resistant and sanitary.

In use, the device may be placed on the floor of a tub or shower in a convenient location. The user may then sit or stand, placing one foot on the curved foot rest portion which will elevate the foot and leg to a convenient position so that the necessary grooming operation can be performed.

In other embodiments, a hanger is slidably mounted with respect to the housing. The hanger has a downwardly depending flange so that the hanger may be extended from the body at a selected distance and the flange engaged over the edge of the tub or wall to support the device.

While the support is intended primarily for use in the bath or shower, it is obvious the support can be used by a person when not showing, as for example to assist in performing a pedicure. In this situation, the device can be removed from a stored location and be placed on a floor surface. The person can then conveniently sit on a stool or bed resting his or her foot on the curved foot support surface.

BRIEF DESCRIPTION OF THE DRAWINGS

The above and other objects of the present invention will become more readily appreciated and understood from a consideration of the following description, claims and accompanying drawings in which:

DETAILED DESCRIPTION OF THE DRAWINGS

Figure 15:
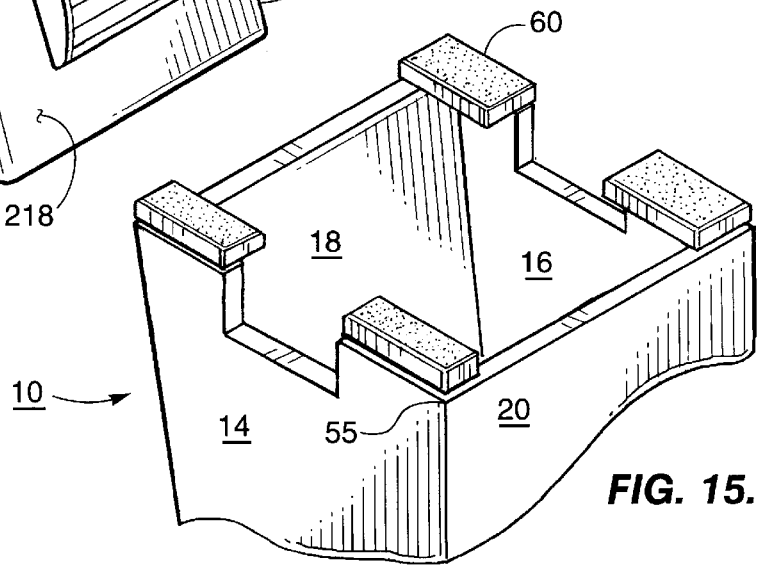
FIG. 15 is a perspective view of the bottom of the foot support device as shown in FIG. 1 with the anti-skid foot pads attached.

Turning now to the drawings, particularly FIGS. 1 to 7 and 15, the foot support of the present invention is generally designated by the numeral 10. The support is shown as being generally rectilinear and formed as an integral unit. The support has a generally planar top surface 12, opposite side walls 14 and 16, front wall 18 and rear wall 20. The walls form a structure having an open bottom as shown in FIG. 15. The support can be of any convenient size and typically is compact being approximately 13" high, 14" wide and 14" deep, although it will be apparent the dimensions may vary. Preferably the device is integrally molded as by injection molding as from a suitable plastic material such as acrylics, vinyl, ABS or other materials which will resist corrosion, provide a neat, clean appearance and be easy to clean and sanitary. The support may be provided in various colors to match or compliment the decor of the bath of the user.

Figure 4:
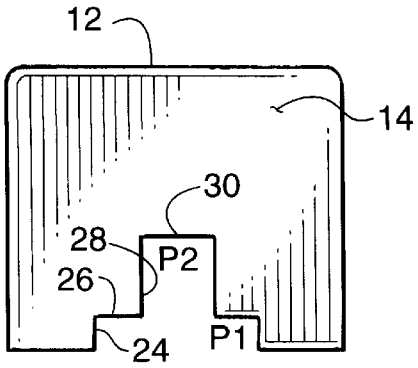
FIG. 4 is a view of the left side of the foot support as seen in FIG. 1 with the right side being identical.

The opposite side walls 14 and 16 each define a cut-out as seen in FIG. 4. The cut-out has first vertical walls 24 spaced apart a distance D1. The walls 24 extend upwardly to a horizontal surface 26 which is intercepted by vertical walls 28 spaced apart a distance D2. Walls 28 extend upwardly towards the top surface terminating at horizontal surface 30. Thus, it will be seen that the side walls each define a generally "stepped" cut-out. It will be appreciated that while the walls are shown having cut-outs or recesses of widths D1 and D2, additional cut-outs or recesses can also be provided. The purpose of the cut-outs is to allow the support to be supported in a non-use position on the side wall W of a structure such as a bath tub.

Figure 6:
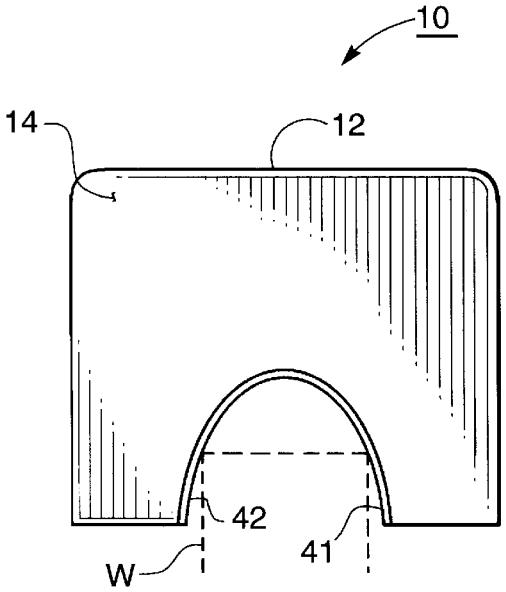
FIGS. 6 and 6A are side views illustrating alternate configurations of the mounting cut-out.
Figure 6A:
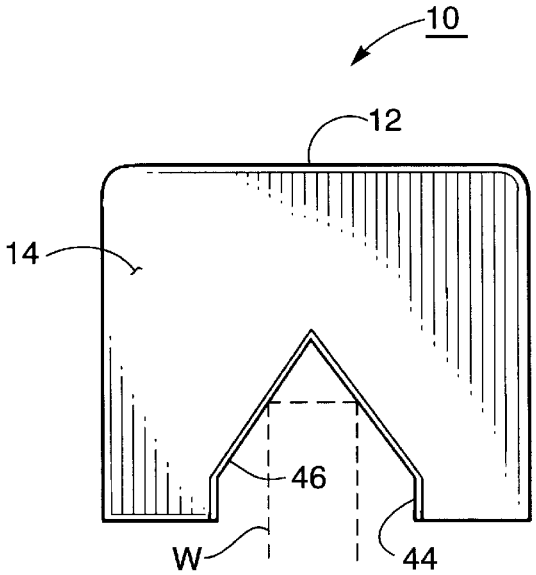
Figure 7:
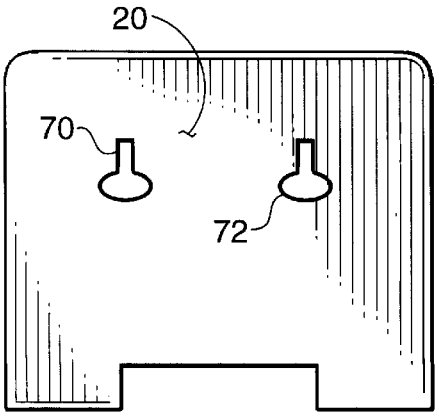
FIG. 7 is a rear view thereof.

FIG. 6 shows an alternate embodiment in which cut-out 41 is a generally upwardly converging inverted U-shape having an edge with a frictional covering 42. FIG. 6A is similar and the cut-out 44 is an inverted V-shape with anti-slip edge 46. The cut-outs are provided in opposite side walls 14, 16.

Figure 1:
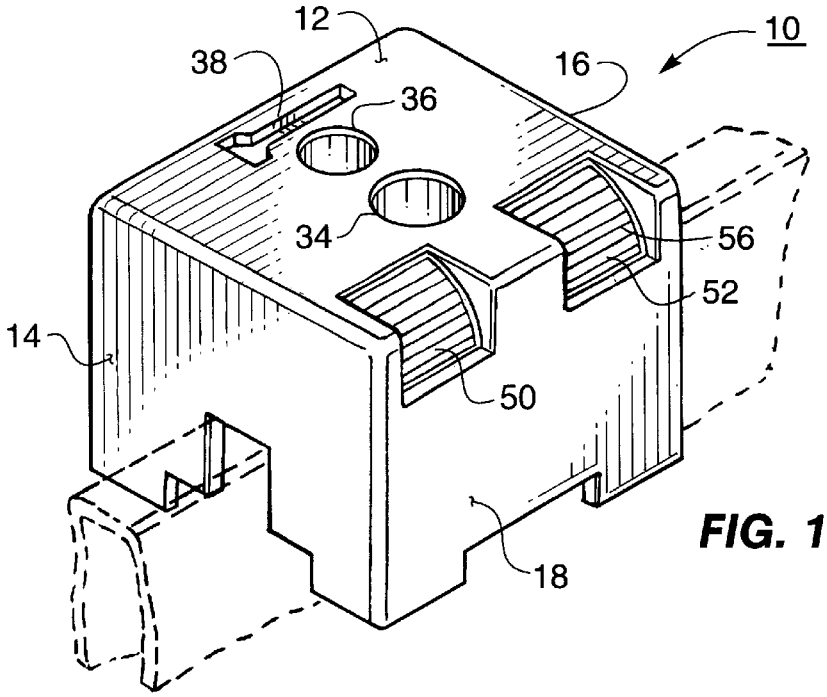
FIG. 1 is a perspective view of a preferred embodiment of the foot support of the present invention shown mounted on the side wall of a bath tub which wall is indicated in dotted lines.
Figure 2:
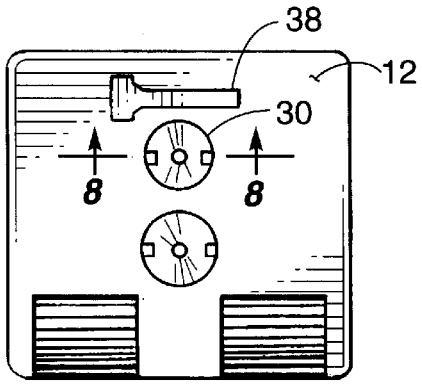
FIG. 2 is a top view thereof.
Figure 3:
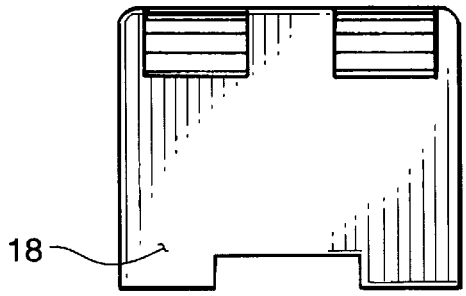
FIG. 3 is a front view thereof.

Referring to FIG. 1, it will be seen that the device can be engaged over the wall W with the upper surface of the wall retained within the upper cut-out. Since the width of tub walls vary, the lower cut-out having a width D1 could be used to support the device on a tub wall of greater width. This allows the device to be stored in a convenient and accessible location off of the floor of the tub or shower when not in use. The support can be simply removed by lifting it from the tub or shower wall and placing it within the bathing enclosure or on a surface when performing a grooming operation. The cut-outs 41 and 44 similarly will engagingly support the device on a wall W and will accommodate different wall thicknesses seating on the wall at an appropriate location within the cut-outs.

Grooming operations are further facilitated by storage areas 34, 36 and 38. Storage areas 34 and 36 are generally cylindrical and dimensioned so as to receive items such as a cannister of shaving cream or gel or lotions that may be used and applied to the legs after shaving. The recess 38 is generally T-shaped to receive a conventional safety razor.

Figure 8:
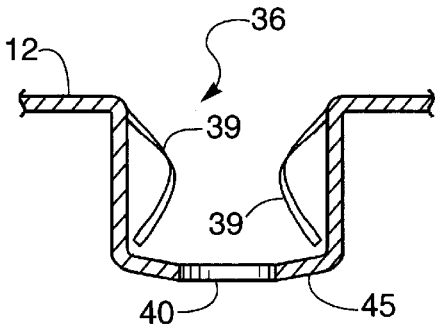
FIG. 8 is a cross-sectional view taken along line 8—8 of FIG. 2.
Figure 9:
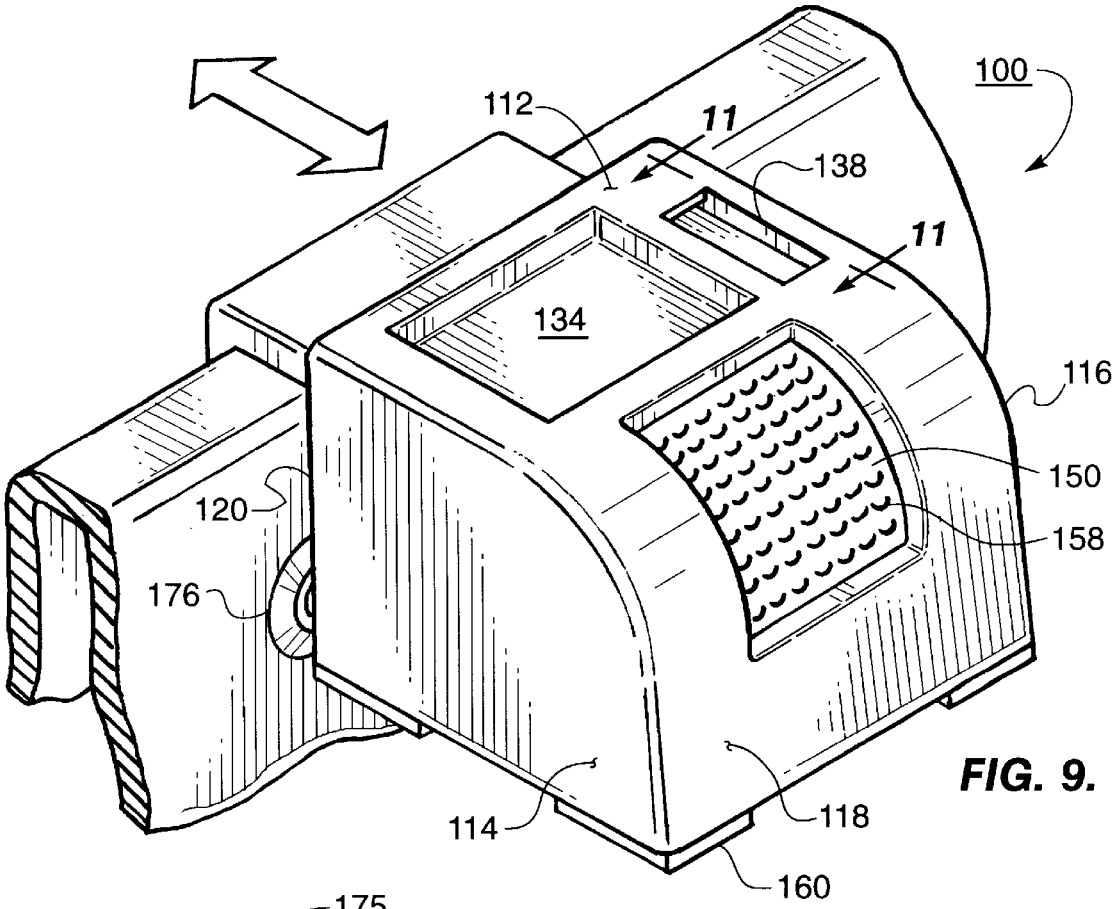
FIG. 9 is a perspective view of yet another embodiment of the present invention.

As seen in FIG. 8, storage areas 34 and 36 are well-like and preferably have spring-like retainers 39 which will deflect to engage the side wall of a cannister and retain it in position.

Figure 5:
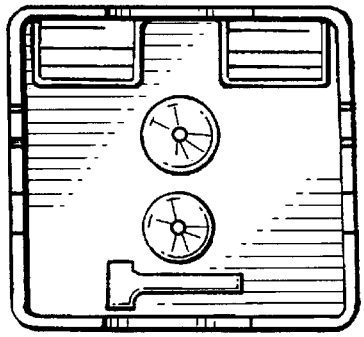
FIG. 5 is a bottom view thereof.

The bottom surfaces of each of the recesses defines a central drain hole 40 and preferably the bottom surfaces 45 are slightly inclined to direct water to the drain hole 40 as best seen in FIGS. 4 and 5.

In use, the foot support of the present invention will receive and elevate the user's foot above the floor of the tub or shower and positions the leg of the supported foot in a bent position convenient for shaving and grooming. The device may also be used when the user is in a sitting position as within a bathtub or on a chair or stool adjacent the support or while standing in a shower stall. To accommodate the user's foot, foot support surfaces 50 and 52 are shown. The foot support surfaces 50, 52 are generally convex curving between front wall 18 to top wall 12. The foot support surfaces 50, 52 are preferably covered with a resilient anti-slip material such as rubber or other elastomer which may be provided with anti-slip features such as ribs 56. In lieu of ribs, small depressions or projections may also be provided to provide suitable frictional resistance. The foot support surfaces are typically about 4" to 5" wide to accommodate feet of various sizes. The user will place the ball of the user's foot or the arch area against the surfaces 50 and 52. Generally the left foot would be placed on surface 50 and the right foot on surface 52.

Referring to FIG. 15, the intersection of side walls with the front and rear walls of the support 10 each define corner areas 55 which are provided with a foot pad 60. The foot pad 60 is a resilient material such as a rubber or elastomeric material with frictional characteristics so as to assist and resist slipping when the device is placed even on a slippery surface such as the floor of a tub or shower.

A principal advantage of the support of the present invention is that it may be stored in an out-of-the-way position on a suitable vertical structure. Keyhole slots 70, 72 are provided in rear wall 20 so the support may be hung on screws secured to a suitable storage location such as a vanity or closet wall.

FIGS. 9 through 12 show yet another embodiment of the present invention generally designated by the numeral 100. In this embodiment, the foot support is a unitary structure which is preferably molded from a suitable plastic having side walls 114, 116, front wall 118, top wall 112 and rear wall 120. The housing defines an open bottom having foot pads 160 located on the bottom edge of the walls in the corner areas. Recesses 134, 138 in the top surface 112 define receptacles or trays for receipt and storage of grooming aids.

A foot support area 150 which again is generally convex, extends between the top wall and the front wall and is covered with a suitable resilient frictional material 158 which will comfortably receive the foot and resist slipping with respect to the foot.

Figure 10:
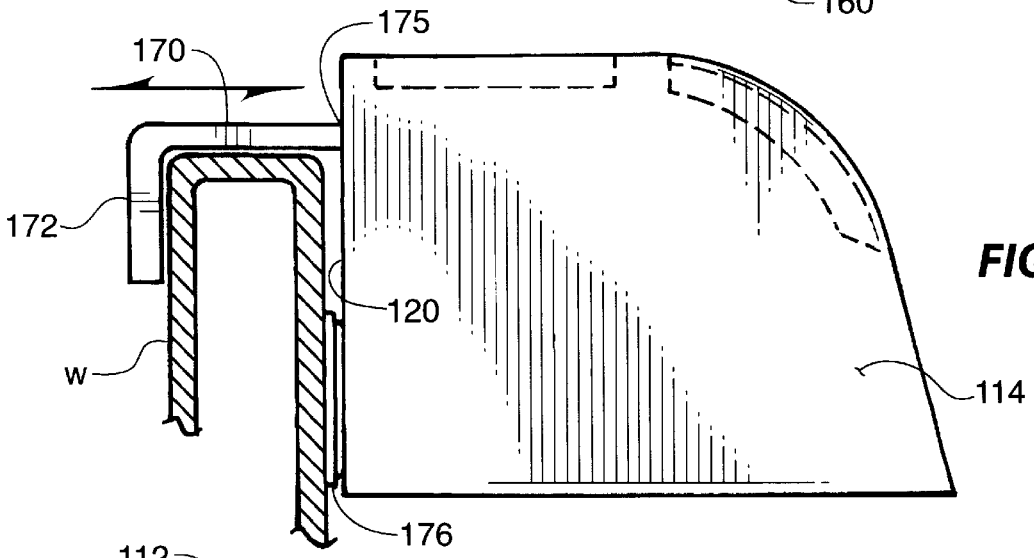
FIG. 10 is a side view of the embodiment shown in FIG. 8 suspended on a tub wall with the tub side wall being shown in cross-section.

In the embodiment of these drawing figures, a hanger 170 is slidably received within a slot 175 in the rear wall. The hanger 170 has a downwardly depending flange 172. This allows the hanger 170 to be selectively positioned spaced from the rear wall 120 a selected distance so that the flange 172 may be engaged over a suitable object such as a tub wall "W" as seen in FIG. 10. A suction cup 176 is attached to the rear wall 120 and will serve to both provide cushioning between the rear wall and the tub wall (W) and will also assist in retaining the foot support in the stored position shown in FIGS. 9 and 10.

Figure 11:
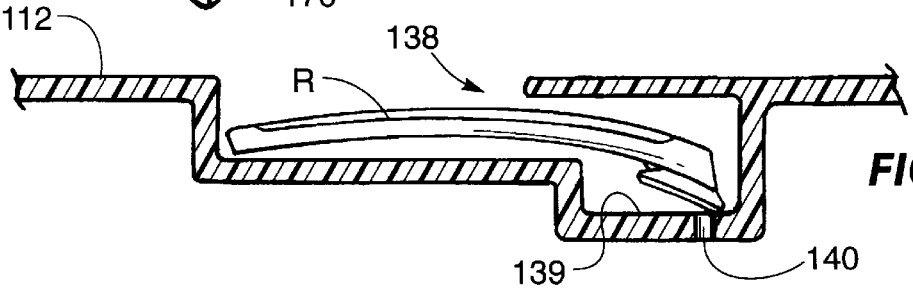
FIG. 11 is a partial sectional view taken along line 11—11 of FIG. 9 with a razor shown in the recess.

The receptacle area 138 is shown in FIG. 11 and has a deeper well area 139 at one end which defines a weep or drain hole 140. This allows articles such as razor R to be conveniently stored in the tray in a position for easy retrieval and replacement. The top surface 112 is shown extending over a part of the receptacle area to maintain the razor in the receptacle.

Figure 12:
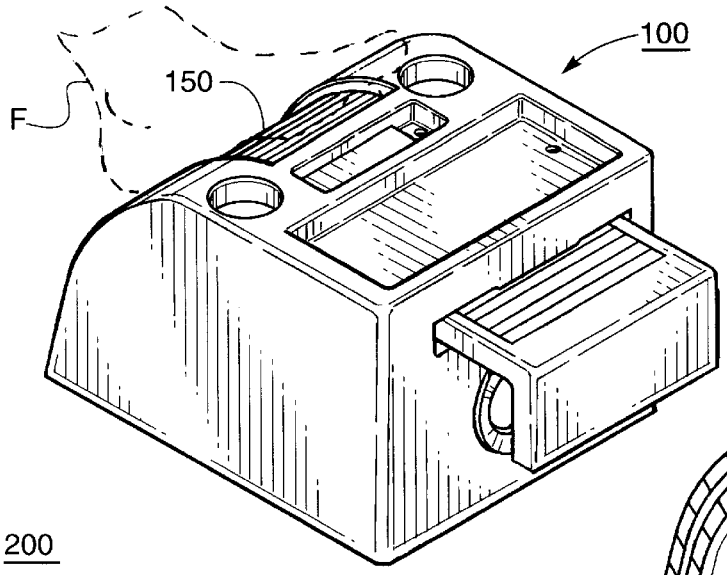
FIG. 12 is a rear perspective view of the embodiment of FIG. 9 shown in a position of use with the person's foot shown in dotted resting on the foot support surface.

FIG. 12 shows the embodiment 100 in a position of use. In FIG. 12, the foot support 100 has been removed from the storage position on tub wall or similar structure and placed on a surface such as the surface of a shower. The user's foot "F", shown in dotted, is positioned on the convex foot support surface 150 with the ball of the foot resting on the curved surface to support the foot so that the leg of the user is in an elevated, convenient position for grooming.

Figure 14:
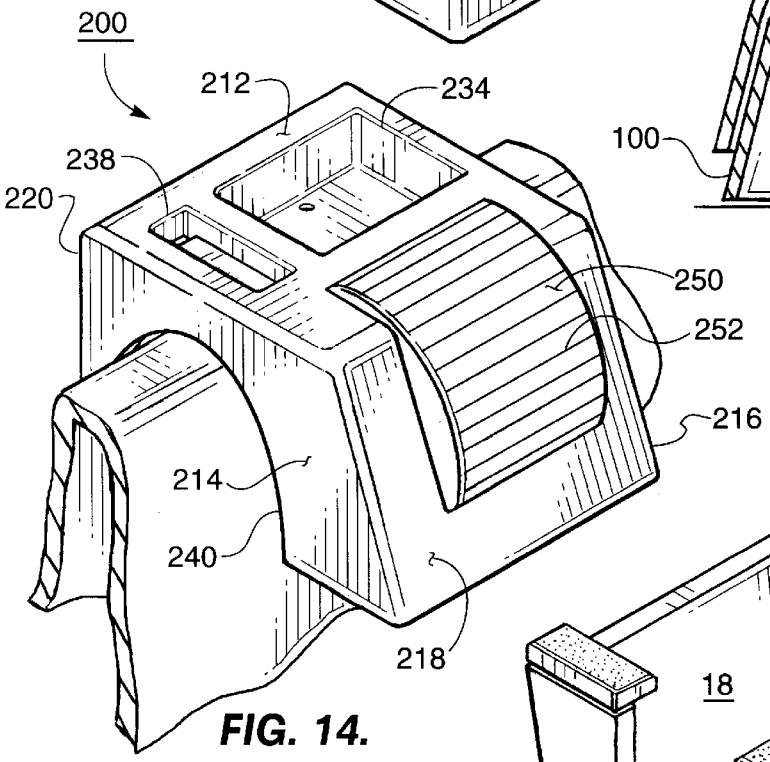
FIG. 14 is a perspective view of yet another embodiment of the present invention.

FIG. 14 illustrates yet another embodiment of the present invention which is generally designated by the numeral 200 and again has side walls 214, 216, front wall 218, rear wall 220. The top wall 212 defines recesses 234 and 238 for receipt of grooming articles such as soaps, lotions, razors and the like. The foot support surface 250 is shown as being a resilient member molded or otherwise formed from a material such as polyurethane or the like and having an arcuate foot support surface 250. Ribs 252 are provided to resist slipping. The foot support surface 252 is relatively wide extending substantially the width of the device. The side walls 214, 216 define recesses 240 which can be engaged over a structure such as a tub wall W and firmly seated thereon.

Figure 13:
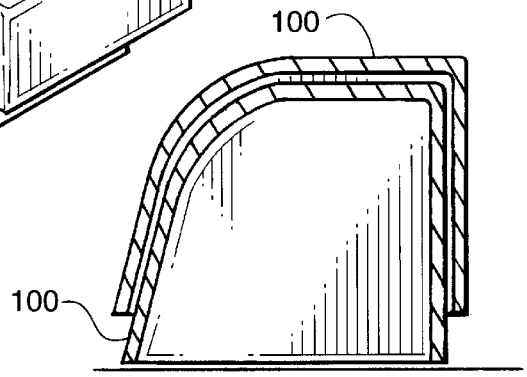
FIG. 13 is a cross-sectional view showing multiple supports nestably stacked for storage and shipping.

Another advantage of the foot support of the present invention is that the various embodiments are nestable and stackable as seen in FIG. 13 which illustrates several supports 100. This feature is advantageous for the manufacturer and shipper as multiple units can be compactly stacked for inventory and shipping requiring only limited space.

From the foregoing, it will be seen that the present invention provides a foot support device that can be used on various surfaces to allow a person to support his or her foot in order to position the person's leg for shaving or other cosmetic treatments. The device may be used not only in a bath or shower enclosure but on a floor and may also benefit elderly or infirmed persons who may have some difficulty in bending sufficiently to reach the lower leg or foot in the normal standing position, thus allowing them to perform pedicures, apply lotions, ointments or the like. The support is portable and may be conveniently transported from one area to another for use as from the bath to the bedroom or vanity. When not in use, the support is easily stored as it can be suspended from a structure such as a tub wall or can be stored in an out-of-the-way position such as within a bathroom vanity. The device is sanitary, does not have any sharp edges or corners which may present a hazard to the user.

Another advantage of the present invention is that it does not require any special installation or attachment to the shower or tub enclosure.

It will be obvious to those skilled in the art to make various changes, alterations and modifications to the invention described herein. To the extent such changes, alterations and modifications do not depart from the spirit and scope of the appended claims. They are intended to be encompassed therein.

What is claimed is:

1. A foot support for supporting the foot of the user to position the user's leg in a position convenient for grooming, said foot support comprising:

(a) a base having opposite side walls, a front wall and top wall forming a generally rectangular structure with a bottom edge;

(b) said base having hanger means associated therewith for supporting said support in a stored position on a generally vertical wall structure;

(c) a generally convex foot-receiving pad extending between said top wall and said front wall; and (d) said top wall defining at least one receptacle for receiving grooming articles.

2. The foot support of claim 1 wherein said base is integrally formed of plastic.

3. The foot support of claim 1 wherein said pad is a resilient material having a surface provided with frictional features.

4. The foot support of claim 1 having a pair of foot-receiving pads in side-by-side relationship.

5. The foot support of claim 1 wherein said hanger means comprises recesses in said opposite side walls.

6. The foot support of claim 1 wherein said base has a rear wall and wherein said hanger means comprise a generally L-shaped arm projecting rearwardly from said rear wall.

7. The foot support of claim 6 wherein said arm is slidably adjustable with respect to said rear wall.

8. The foot support of claim 1 including anti-slip pads on the bottom edge of said base.

9. The foot support of claim 5 wherein said recesses are generally upwardly converging.

10. The foot support of claim 1 wherein said receptacle has an inclined bottom surface defining a drain hole.

* * * * *